United States Patent [19]

Moncrieff-Yeates

[11] 4,161,171

[45] Jul. 17, 1979

[54] SLIDING FIREPLACE ANDIRONS

[76] Inventor: Alexander J. Moncrieff-Yeates, 8924 Rhyme Ct., Annandale, Va. 22003

[21] Appl. No.: 847,106

[22] Filed: Oct. 31, 1977

Related U.S. Application Data

[63] Continuation-in-part of Ser. No. 729,955, Oct. 6, 1976, Pat. No. 4,096,849.

[51] Int. Cl.[2] ..... F24B 13/00

[52] U.S. Cl. ..... 126/298; 126/120; 126/164

[58] Field of Search ..... 126/298, 202, 336, 201, 126/203, 152, 153 R, 153 A, 153 B, 120, 121, 123, 163 A, 163 R, 164

[56] References Cited

U.S. PATENT DOCUMENTS

| | | | |
|---|---|---|---|
| 475,701 | 5/1892 | Paschal | 126/336 |
| 1,322,603 | 11/1919 | Norman | 126/121 UX |
| 2,050,591 | 8/1936 | Stephenson | 126/164 |
| 2,762,363 | 9/1956 | Hager | 126/298 |
| 4,010,729 | 3/1977 | Egli | 126/164 X |

FOREIGN PATENT DOCUMENTS

| | | | |
|---|---|---|---|
| 422935 | 1/1935 | United Kingdom | 126/203 |
| 596723 | 1/1948 | United Kingdom | 126/164 |

*Primary Examiner*—Dennis L. Taylor
*Attorney, Agent, or Firm*—Sixbey, Friedman & Leedom

[57] ABSTRACT

A set of fireplace andirons are slidable with respect to the fuel (log) supports. The unit may be formed integrally with a fireplace structure or as a separate distinct assembly. The sliding anvils may support other elements, such as a cooking grill.

10 Claims, 6 Drawing Figures

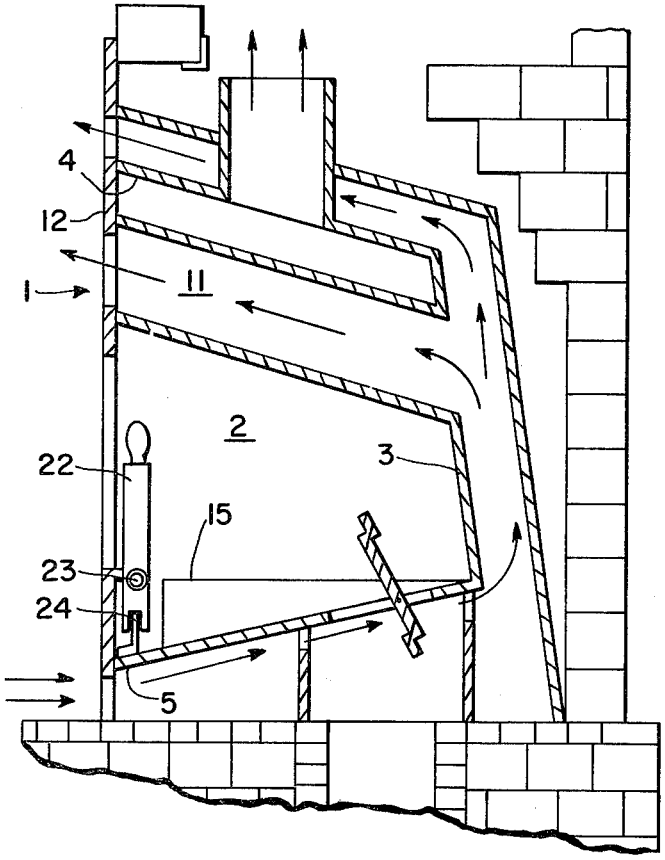
FIG. 1
FIG. 2
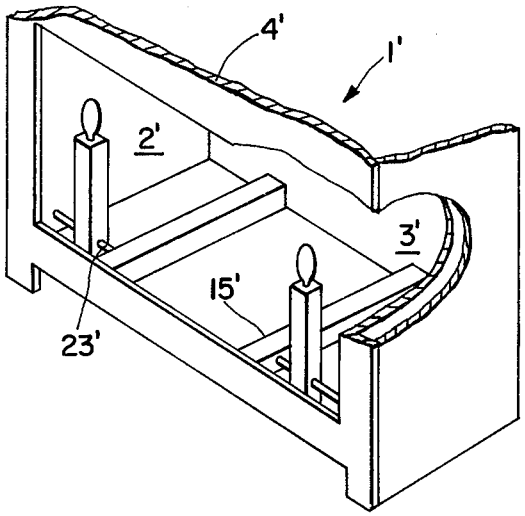
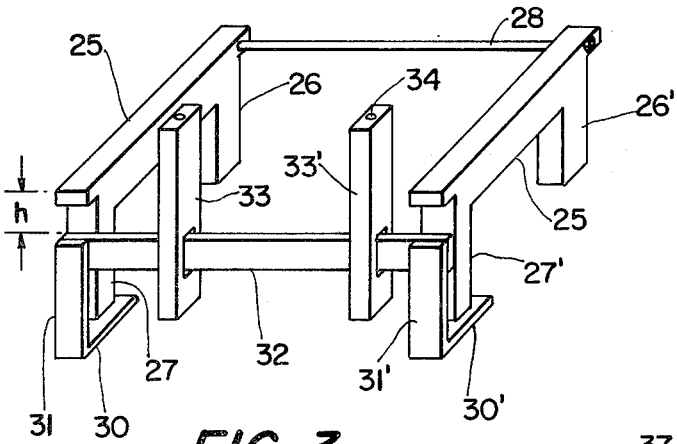
FIG. 3
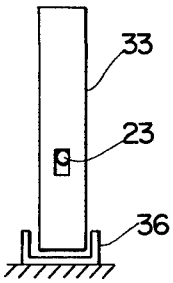
FIG. 4a
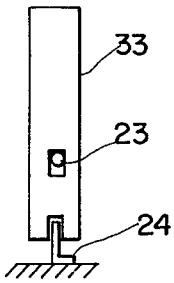
FIG. 4b
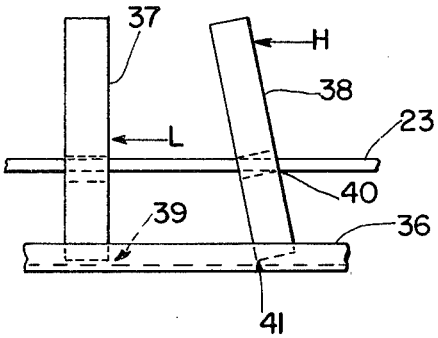
FIG. 5

SLIDING FIREPLACE ANDIRONS

RELATED APPLICATION

This application is a continuation-in-part of my application Ser. No. 729,955 filed Oct. 6, 1976, now U.S. Pat. No. 4,096,849.

FIELD OF THE INVENTION

This invention relates generally to andirons and fuel supports for fireplaces, either constructed integrally with a fireplace unit or as a separate assembly, and specifically to an assembly wherein the andirons are movable laterally of the fireplace and independent of any movement of the log supports.

BACKGROUND OF INVENTION—PRIOR ART AND TERMINOLOGY

An andiron/fuel support for a fireplace is commonly referred to as a firedog because of its surrealistic resemblance to a dog. It includes an integral assembly of four legs depending from an elongated horizontal body (the log support) and at its forward end, an upwardly extending neck frequently topped by an ornamental head. The complete unit is placed in accordance with the desires of the user regarding spacing of one from the other laterally in the fireplace.

It is proposed in Yarborough et al U.S. Pat. No. 944,980 to tie two fire dogs together by a brace rod 6 to keep the firedogs parallel to one another while permitting them to be slid as a unit along the guide rod for lateral placement.

Because this invention draws a distinction over the integral fire dog construction disclosed above, it will be described by the terms "andiron" and "grate", it being understood that the term "andiron" refers to the upright barrier which prevents fuel from tumbling forwardly out of the fireplace, whereas the term "grate" refers to a generally horizontal member which supports the fuel above the bed of a fireplace enclosure.

It should also be recognized that the term "fireplace" contemplates conventional fireplaces constructed integrally with a chimney, insert units therefore, and free standing heating units employing grates and andirons whether used for space heating, cooking, etc., otherwise termed heaters, stoves, furnaces, etc.

OBJECTS OF THE INVENTION

In the aforedescribed prior art, the firedogs are placed in position and fuel is loaded thereon. Once the weight of the fuel is imposed upon the firedog, it becomes difficult to move either firedog and, if movement is accomplished through the use of force, the fuel is disrupted in the process. This disruption may result in fuel dropping clear of the firedogs to the hearth, thus preventing return of the firedogs to their original effective position. The risk of burning fuel tumbling out of the fireplace is obvious. Faced with these consequences, the user is reluctant to move the firedogs and is thus forced to add fuel by lifting it over the head of the firedog or snaking it between the necks thereof, either of which is difficult and dangerous, particularly when large or heavy logs are employed.

It is a primary object of this invention to eliminate the aforedescribed difficulties of the prior art by providing a structure wherein 1. andirons are movable independently of the associated grate, 2. andirons are guided along a unique track structure, and
3. the engagement of the andirons with the track resists undesired movement by pressure of logs but permits movement by hand.

DESCRIPTION OF THE DRAWING

The aforestated objects, as well as other self-evident objectives and advantages of this invention will be apparent from a consideration of the ensueing application and drawings, in which FIG. 1 is a side view in section of a fireplace unit including one embodiment of this invention, FIG. 2 is a fragmentary view in perspective of a fireplace unit including another embodiment, FIG. 3 is a perspective view of a further embodiment, FIGS. 4*a* and 4*b* are detail views, and FIG. 5 is an elevational view of the detail of FIG. 4*a*.

Referring first to FIG. 1, a fireplace unit is indicated generally at 1, and is of the type set forth in my aforesaid application Ser. No. 729,955. This unit includes a fire enclosure defined by side walls 2, a rear wall 3, a top wall 4, and a bed plate 5. An access opening is provided in front panel 12.

The bed plate 5 may appropriately be provided with grates 15 extending fore and aft of the fire enclosure and adapted to the contour of the bed plate and presenting a horizontal upper surface for support of the fuel. Alternatively, the upper surface may be contoured sloping downwardly to the rear or concavely to have their lowest point in the center. The grates 15 are rigidly attached to the bed plate to provide reinforcement thereto, and this invention contemplates andirons which are translatably movable in a lateral, or side-to-side direction of the fire enclosure to accomodate various lengths of logs and to facilitate loading or rearranging logs and cleaning the unit. Yet, inasmuch as the grates are elevated considerably above the hearth level, it is equally desireable that the andirons be firmly attached to the unit, as logs which might otherwise tumble from the grate would be likely to acquire sufficient momentum to cause them to roll beyond the hearth into the room. To this end, there is provided a horizontal rod 23 at a location between the grate and the fire enclosure opening and at a height approximately that of the top surface of the grate. Directly underlying the rod is a guide rail 24, here shown as including an upstanding flange affixed to the bed plate 5. Each of two andirons 22 (omitted from FIG. 3 for purposes of clarity) comprise vertical tubular elements which include apertures for reception of the supporting rod 23 and a bifurcated lower extremety in registry with the guide rail 24. It can be readily seen that each andiron 22 can be easily adjusted, and that once in position its weight and its frictional engagement with the rod and rail 24 will hold it in position. The andirons are readily moveable to an out of the way position to facilitate movement of ashes in front of the permanently affixed grates 15 during the process of cleaning the unit.

In a second embodiment illustrated in FIG. 2 the integral grates 15' extend forwardly to the front panel 4', thus further rigidifying the fireplace unit as a whole. In this embodiment, movement of the anvils is limited to the area outboard of the grates, i.e., between a grate member 15' and the adjacent side wall 2'. The track structure is similar to that of FIG. 1 and provides a rod 23' and an underlying guide rail (not shown), each of which extend between the fixed grate and the adjacent side wall. Obviously, only one andiron need be made movable in a structure which would still facilitate placement of logs, albeit to a lesser degree.

This invention further contemplates an assembly in which anvils are translatably movable with respect to their associated grates, but which is independent of the fireplace unit and hence usable in pre-existing fireplaces. Such an assembly is shown in perspective in FIG. 3. The log support is shown as two spaced grates 25, 25' each having depending legs 26, 26' and 27, 27' each of which may also have foot portions (not shown) for stability. While shown as log supporting members, the term "grate" is meant to include such analogous structures as baskets for support of fuel in the nature of cool or small wood pieces. The grates may be further stabilized by one or more interconnecting tie rods 28. Each front leg 27, 27' rests upon a respective foot portion 30, 30' of upright support members 31, 31', and may be attached thereto or simply rely upon the weight of the grate to keep them in place. Extending between the supports 31, 31' is a supporting rail 32 shown in FIG. 3 as a bar of noncircular, in this case rectangular, cross-section. The supporting rail extends in front of the grates 25, 25' at a level substantially below the level of the log support surfaces of the grates.

Slidably carried upon the support rail are the andirons 33, 33' each of which includes an aperture of complementary, in this case rectangular, form and of a size slightly larger than that of the support rail 32, thus providing a clearance fit. Each andiron is provided at its top surface with connecting means such as a threaded hole to which an ornamental head, a cooking grill, or other device may be attached.

The clearance fit between the andiron 33 or 33' and the support rail is important to one aspect of this invention. It has been found that for given dimensions chose in accordance with the formula $$(\mu h)/a \geqq 0.5$$

where $\mu$ is the coeffecient of friction between andiron and rail, h is the height of the grates above the rail, and a is the length of the aperture, a force applied against the andiron 33 or 33' at a point near the support rail 32 will readily cause the andiron to slide along the rail, whereas a force applied high above the rail will tend to cant the andiron causing binding at the clearance fit, whereby the andiron will resist movement. With these dimensions, should a log become dislodged from behind one andiron and fall to a position where a force is exerted against the other andiron which force has a component in a direction parallel to the rail, the frictional resistance to movement will result in the andiron canting because the force is applied at or above the level of the grates. The result is that the edges of the aperture grip the rail, preventing movement of the andiron along the rail, thus avoiding freeing the log to fall completely free of the assembly. The safety implications are evident. Notwithstanding the resistance to unwanted and unsafe movement, the andirons are readily moved by resting a poker on the top surface of rail 32 and pressing against andiron 33 or 33' at a point below the fuel supporting surface of the grate near the support rail.

A preferred embodiment constructed in accordance with the aforementioned formula includes an andiron constructed of hot roll steel having an aperture $\frac{3}{8}$ inches long coacting with a supporting rail constructed of cold roll steel and cross-sectional dimension $\frac{3}{8}$ inches$\times\frac{1}{4}$ inches with a clearance of $\frac{1}{2}$. The grate is at least $\frac{1}{2}$ inches above the supporting rail.

While the embodiment of FIG. 3 has been described utilizing a rectancular cross-section rail 32, other support means in the form of a trackway composed of a support rail and a guide rail may be employed in an assembly similar to that of FIG. 3. Not only is the trackway seen in FIG. 1 comprising a supporting rail in the form of rod 23 and a guide rail 24 in the form of an angle iron, applicable to FIG. 3, but the alternatives illustrated in FIGS. 4(*a*) and 4(*b*) may also be employed. In each of these figures, andiron 33 is provided with a vertically elongated aperture surrounding supporting rod 23 which in itself provides no resistance to rotation about the axis of the rod. The latter function is provided by a guide rail in the form of channel 36 embracing the lower portion of the andiron (FIG. 4*a*) or a guide rail 24 in the form of an angle iron having a web registerable in a slot formed in the lower end of the andiron. In each case, the clearance dimensions between guide rail and andiron are close. The vertically elongated rectangular aperture permits the andiron to tilt in the plane of the support rod 23 when subjected to force applied at a high point (i.e., grate level or higher), and such tilting will bring a bottom edge of the andiron 33 into registry with the guide rail, causing the andiron to bind between guide rail 24 or guide channel 36 and the support rail 23, thus accomplishing the same advantages or just described in connection with FIG. 3. This binding action is illustrated more clearly in FIG. 5, wherein an andiron 37 is illustrated at rest or free moving position and an andiron 38 is illustrated in binding condition. Note that andiron 37 is supported solely by supporting rail 23, thus maintaining clearance above guide channel 36 at its point of registry when at rest. When a low moment of force is applied, as by pressure applied at L to move the andiron 37 along rail 23, the andiron easily overcomes its coefficient of friction with rail 23, and translational movement occurs without change of the clearance relationship with guide channel 39. However, if a force of high moment is applied at point H, as would occur by a log becoming partially dislodged, the frictional relationship is not overcome by the force, moment of force or turning effect being the product of force and the perpendicular distance of the point of application of the force from the line of action of the force. Thus, the andiron 38 tilts to bring its lower corner into contact with the bottom of guide channel 36 at point 41 and the lower edge of the aperture in contact with the lower surface of support rail 23, at which point the andiron is wedged against further translatory motion. Removal of the force enables the andiron to resume its upright position, thus reestablishing the clearance.

I claim:

1. In a heating unit of the type which includes a room air recirculating passageway and includes a fire enclosure defined in part by a bed plate, the improvement wherein the bed plate includes spaced stationary grates extending fore and aft of said bed plate and rigidly affixed thereto throughout their fore and aft dimensions to provide integral reinforcement for said bed plate and further including andirons, means mounting said andirons to said unit for side to side movement in a path across the front portion of the fire enclosure at the front of said bed plate, said mounting means comprises a horizontal rod which extends across at least a portion of the front of said enclosure in a position spaced above the bed plate, and said mounting means further comprises a guide rail which extends across at least a portion of the front of said bed plate at approximately the level thereof, and each said andiron includes means registering with said rod and with said guide track to permit movement therealong.

2. The heating unit set forth in claim 1 wherein said means mounting said andirons for side to side movement extends between at least one said stationary grates and the adjacent side wall of said fire enclosure to permit movement only outboard of said grates.

3. For use in a fire enclosure, the combination of a stationary grate structure including a fuel supporting surface and an independent andiron structure translatably movable laterally of said grate structure, and further including means supporting said andiron, said supporting means comprising an elongated laterally extending supporting rail of non-circular cross-section, said andiron including an aperture of complementary cross-section through which said rail extends, said aperture providing a clearance fit which enables said andiron to be freely moved along said supporting rail while said non-circular cross-section resist pivotal movement of said andiron about said supporting rail.

4. The combination of claim 3 wherein said supporting rail is below the level of the fuel supporting surface of said grates.

5. The combination of claim 3 wherein the length of said aperture, the clearance of the fit of said aperture the clearance of the fit of said aperture with said support rail, and the height of said fuel supporting surface above said support rail are chosen in accordance with the formula $$(\mu h/a) \geqq 0.5$$

where $\mu$ is the coefficient of friction between said andiron and said supporting rail, h is the height of said fuel supporting surface, and a is the length of said aperture.

6. For use in a fire enclosure, the combination of a stationary grate structure including a fuel supporting surface and an independent andiron structure translatably movable laterally of said grate structure, and further including supporting means supporting said andiron, said supporting means comprising an elongated laterally extending supporting rail, said andiron including an aperture through which said rail extends, said aperture providing a clearance fit which enables said andiron to be freely moved along said supporting rail, and a guide rail parallel to and spaced from said support rail, said andiron including means registerable with said guide rail to resist pivotal movment of said andiron about said support rail.

7. The combination of claim 6 wherein said guide rail is in the form of a channel registerable with said andiron by embracing a portionthereof.

8. The combination of claim 6 wherein said guide rail includes a web and said andiron includes a slot registerable with said web by embracing a portion thereof.

9. The combination of claim 6 wherein said aperture is vertically elongated to permit the tilting of said andiron in a plane defined by said support and guide rails whereupon said means registerable with said guide rail comes into contact with said guide rail to wedge said andiron between said supporting and said guide rails.

10. For use in a fire enclosure, the combination of a stationary grate structure including a fuel supporting surface and an independent andiron structure translatably movable laterally of said grate structure, wherein said andiron structure comprises an elongated substantially vertical member, and fastening means disposed upon the upper portion of said vertical member.

* * * * *